US007636965B1

(12) United States Patent
Tucker

(10) Patent No.: US 7,636,965 B1
(45) **Date of Patent: *Dec. 29, 2009**

(54) BEDDING ACCESSORY FOR ARTICLE STORAGE

(75) Inventor: Holly S. Tucker, Hendersonville, NC (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/240,041

(22) Filed: Sep. 29, 2008

Related U.S. Application Data

(63) Continuation of application No. 12/183,069, filed on Jul. 31, 2008, and a continuation-in-part of application No. 11/901,256, filed on Sep. 14, 2007.

(51) Int. Cl.
*A47G 9/02* (2006.01)

(52) U.S. Cl. ..... 5/493; 5/485; 5/503.1

(58) Field of Classification Search ..... 5/493, 5/485, 503.1, 695; 297/188.2; 108/90; D6/596, D6/603
See application file for complete search history.

(56) References Cited

U.S. PATENT DOCUMENTS

| | | | | |
|---|---|---|---|---|
| 2,359,372 A | | 10/1944 | Leader | |
| 2,532,517 A | | 12/1950 | Schwartzman et al. | |
| 2,641,001 A | | 6/1953 | Krasnov | |
| 2,763,875 A | | 9/1956 | Piontkowski | |
| 4,131,313 A | * | 12/1978 | Jacobs | 297/188.2 |
| 4,309,784 A | * | 1/1982 | Cohen | 5/639 |
| 4,585,127 A | | 4/1986 | Benedict | |
| 4,686,726 A | | 8/1987 | Dunfee | |
| D314,304 S | | 2/1991 | Levine | |
| 5,271,112 A | | 12/1993 | Bible et al. | |
| 5,279,009 A | | 1/1994 | Putka, Jr. | |
| 5,581,829 A | | 12/1996 | Lee | |
| 5,733,397 A | | 3/1998 | McDaniel | |
| 5,737,785 A | * | 4/1998 | Casey | 5/419 |

(Continued)

OTHER PUBLICATIONS

Information Disclosure Statement (IDS) Letter Regarding Common Patent Application(s), submitted by Applicatnt on Sep. 17, 2009.

(Continued)

*Primary Examiner*—Michael Trettel
(74) *Attorney, Agent, or Firm*—Chad D. Tillman; James D. Wright; Tillman Wright, PLLC

(57) ABSTRACT

A bedding accessory for storing shoes in the space fully beneath a bed frame includes a sheet portion, side portions appended to an edge of the sheet portion, and storage compartments formed on the side portions. The sheet portion is placed in substantially covering relation to an upper surface of a mattress support structure. The side portions are arranged to hang downwardly from the sheet portion adjacent the space beneath the bed frame. Each storage compartment is configured to retain a pair of shoes therein and is comprised of an outer panel facing outwardly away from the bed frame and an inner panel facing inwardly toward the space beneath the bed frame. The inner and outer panels of each storage compartment jointly define an opening for receipt of a pair of shoes, and the compartment substantially retains the shoes in the space fully beneath the bed frame.

20 Claims, 17 Drawing Sheets

U.S. PATENT DOCUMENTS

| | | | | |
|---|---|---|---|---|
| 5,758,972 | A | 6/1998 | Mack et al. | |
| D409,873 | S * | 5/1999 | Johnson | D6/603 |
| D427,781 | S | 7/2000 | Rogman et al. | |
| D429,897 | S | 8/2000 | Rogman et al. | |
| 6,151,731 | A | 11/2000 | Saparow | |
| 6,349,491 | B1 | 2/2002 | Able | |
| 6,390,715 | B1 | 5/2002 | Gerbasi | |
| 6,431,418 | B1 | 8/2002 | Pease | |
| 6,508,183 | B2 * | 1/2003 | Kerrigan | 108/90 |
| D471,049 | S * | 3/2003 | Dale | D6/596 |
| 6,594,836 | B1 | 7/2003 | Everson et al. | |
| 6,601,250 | B1 | 8/2003 | Taylor | |
| 6,626,491 | B1 * | 9/2003 | Blome et al. | 297/229 |
| D481,899 | S | 11/2003 | Thomas et al. | |
| 6,854,139 | B2 | 2/2005 | Lamy | |
| D546,613 | S | 7/2007 | OConnor | |
| 7,281,281 | B2 | 10/2007 | Langenberger | |
| D577,531 | S * | 9/2008 | Brown | D6/597 |
| 2005/0220370 | A1 | 10/2005 | Kohn et al. | |
| 2008/0222806 | A1 * | 9/2008 | Hart | 5/493 |
| 2009/0113629 | A1 | 5/2009 | Tucker | |

OTHER PUBLICATIONS

Information Disclosure Statement (IDS) Letter Regarding Common Patent Application(s), submitted by Applicant on Jun. 10, 2009.

* cited by examiner

BEDDING ACCESSORY FOR ARTICLE STORAGE

CROSS-REFERENCE TO RELATED APPLICATION

The present application is a U.S. continuation-in-part patent application of, and claims priority under 35 U.S.C. §120 to, U.S. nonprovisional patent application Ser. No. 11/901,256, filed Sep. 14, 2007, and published as U.S. Patent Application Publication No. 2009/0113629 on May 7, 2009, which patent application and publication are incorporated by reference herein. Further, the present application is a U.S. continuation patent application of, and claims priority under 35 U.S.C. §120 to, U.S. nonprovisional patent application Ser. No. 12/183,069, filed Jul. 31, 2008, which patent application and any publication thereof are incorporated by reference herein.

The present application also incorporates, by reference herein, U.S. design Pat. application Ser. No. 29/291,531, filed Sep. 4, 2007, and U.S. Design Pat. No. D587,055, which issued therefrom on Feb. 24, 2009.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention relates to a bedding accessory for storage of articles, and more particularly, to a bedding accessory for storage of articles at least substantially in the space beneath a bed frame.

In terms of storage, the space below a typical bed is one of the most under-utilized areas in the average home. There have been mechanical assemblies designed to utilize that space, but no one has provided a convenient bedding accessory to do so. Many designs for bedding are intended to occupy areas adjacent to the bed for storage, some near the floor, and others at mattress level.

A number of pocketed bed shams have been proposed. U.S. Pat. D481,899 provides an odd-looking tarp, which suggests that pockets would be useful on the exterior. But this design does not have the slack required to allow storage to rest underneath the bed. U.S. Pat. No. D471,049 depicts a dust ruffle with storage. Due to the excess of material, this storage will obstruct the floor area surrounding the bed, when it is occupied. Neither of these two designs, unfortunately, will function with a footboard, and neither will tend to utilize the space underneath the bed itself.

U.S. Pat. No. 5,279,009, U.S. Pat. No. 5,581,829, U.S. Pat. No. 6,594,836 and U.S. Pat. No. 6,601,250 all indicate pockets on the sides of a mattress, which take up otherwise useful space, while causing stored articles to actually become a hindrance to normal activities, such as sitting on the edge of the mattress.

Again, all of these items fail to effectively utilize the actual volume directly below the box-spring. More specifically, no bedding apparel prescribes a use to optimize its own material, and maximize storage capacity.

As such, a need exists for improvement in the field of space-saving accessories. These, and other needs, are addressed by one or more aspects of the present invention.

SUMMARY OF THE INVENTION

The bedding accessory is a storage solution to those with limited closet space (or just too many shoes) because it takes the storage out of the closet and brings it into the bedroom—using the dead space already existing under your bed frame. This area has historically been under-utilized. The bedding accessory is mainly a woman's product for women's shoes. Men can appreciate it if they are married to women with too many shoes, though. The bedding accessory, however, can store things other than shoes.

Thus, it is an object of this invention to provide a pocketed bedskirt that utilizes a portion of the space directly under a bed, by having pockets that are pleated on the portion that is interior to the bedskirt.

It is another object of this invention to provide a pocketed bedskirt that is slotted, so that it functions on any bed, and not just beds without a footboard.

It is yet another object of this invention to provide a pocketed bedskirt that allows the contents in storage to be visible through the pocket material.

It is still another object of this invention to provide a pocketed bedskirt that maximizes the use of the bedskirt as an under-bed storage device, by utilizing the entire length of the exposed perimeter of the bed.

It is one more object of this invention to provide a pocketed bedskirt that has a clean uniform appearance upon its exterior. The invention provided disguises the bulk of the shoes, and gives a clean look under the decorative bed sham (or dust ruffle), providing hidden shoe storage under your bed frame.

The present invention includes many aspects and features. Moreover, while many aspects and features relate to, and are described in, the context of a bedding accessory for storage of articles, the present invention is not limited to use only as a bedding accessory for storage of articles, as will become apparent from the following summaries and detailed descriptions of aspects, features, and one or more embodiments of the present invention.

Accordingly, one aspect of the present invention relates to a bedding accessory for storing a plurality of articles in the space fully beneath a bed frame, the bedding accessory including: a sheet portion for placement in substantially covering relation to an upper surface of a mattress support structure; at least one side portion appended to an edge of the sheet portion and arranged to hang downwardly therefrom adjacent the space beneath the bed frame; and one or more storage compartments formed on the side portion, each storage compartment being configured to at least substantially retain at least one article therein; wherein each storage compartment is comprised of an outer panel facing outwardly away from the bed frame and an inner panel facing inwardly toward the space beneath the bed frame; wherein the inner and outer panels of each storage compartment jointly define an opening for receipt of an article; and whereby, upon receipt of an article, the storage compartment substantially retains the article in the space fully beneath the bed frame.

In a feature of this aspect, the bedding accessory further includes a cover for at least substantially concealing each storage compartment. In further features, the cover is an integral component of the bedding accessory; or the cover is a separate component of the bedding accessory. In a still further feature, the cover is a dust ruffle.

In another feature of this aspect, the inner panel of each storage compartment includes a pleat for permitting expansion of each storage compartment inwardly into the space beneath the bed frame.

In another feature of this aspect, the side portion is appended only to the edge of the sheet portion adjacent a foot area of the bed frame, whereby an article received in each storage compartment is retained in the space fully beneath the foot area of the bed frame.

In another feature of this aspect, the side portion is appended to the edge of the sheet portion adjacent a lateral side area of the bed frame, whereby an article received in each storage compartment is retained in the space fully beneath the lateral side area of the bed frame.

In another feature of this aspect, each storage compartment is adapted to receive and store a shoe.

In another feature of this aspect, the bedding accessory is usable with a bed frame that includes a footboard.

Another aspect of the present invention relates to a bedding accessory for storing a plurality of articles at least substantially in the space beneath a bed frame, the bedding accessory including: a sheet portion for placement in substantially covering relation to an upper surface of a mattress support structure; at least one side portion appended to an edge of the sheet portion and arranged to hang downwardly therefrom adjacent the space beneath the bed frame; and one or more storage compartments formed on the side portion, each storage compartment being configured to at least substantially retain at least one article therein; wherein each storage compartment is comprised of an outer panel facing outwardly away from the bed frame and an inner panel facing inwardly toward the space beneath the bed frame, wherein, the inner and outer panels of each storage compartment jointly define an opening for receipt of an article, and the inner panel of each storage compartment includes a pleat for permitting expansion of each storage compartment inwardly into the space beneath the bed frame; whereby, upon receipt of an article, the storage compartment substantially retains the article at least substantially in the space beneath the bed frame.

In a feature of this aspect, the bedding accessory further includes a cover for at least substantially concealing each storage compartment. In further features, the cover is an integral component of the bedding accessory; or the cover is a separate component of the bedding accessory. In a still further feature, the cover is a dust ruffle.

In another feature of this aspect, the side portion is appended only to the edge of the sheet portion adjacent a foot area of the bed frame, whereby an article received in each storage compartment is retained at least substantially in the space beneath the foot area of the bed frame.

In another feature of this aspect, the side portion is appended to the edge of the sheet portion adjacent a lateral side area of the bed frame, whereby an article received in each storage compartment is retained at least substantially in the space beneath the lateral side area of the bed frame.

In another feature of this aspect, each storage compartment is adapted to receive and store a shoe.

In another feature of this aspect, the bedding accessory is usable with a bed frame that includes a footboard.

Another aspect of the present invention relates to a method of using a bedding accessory for storing a plurality of articles in the space fully beneath a bed frame, including: providing a bedding accessory having a sheet portion, at least one side portion appended to an edge of the sheet portion, and one or more storage compartments formed on the side portion, each storage compartment being configured to at least substantially retain at least one article therein; arranging the sheet portion of the bedding accessory in substantially covering relation to an upper surface of a mattress support structure; arranging the side portion to hang downwardly from the mattress support structure adjacent the space beneath the bed frame; and placing an article into a selected one of the storage compartments, whereby, upon receipt of the article, the storage compartment substantially retains the article in the space fully beneath the bed frame.

Another aspect of the present invention relates to a bedding accessory for storing at least one shoe at least partially in the space beneath a bed frame, the bedding accessory including: a sheet portion for placement in substantially covering relation to an upper surface of a mattress support structure; at least one side portion appended to an edge of the sheet portion and arranged to hang downwardly therefrom adjacent the space beneath the bed frame; and one or more storage compartments formed on the side portion, each storage compartment being configured to at least substantially retain a shoe therein; wherein each storage compartment is comprised of an outer panel facing outwardly away from the bed frame and an inner panel facing inwardly toward the space beneath the bed frame; and wherein the inner and outer panels of each storage compartment jointly define an opening for receipt of a shoe; whereby, upon receipt of a shoe, the storage compartment substantially retains the shoe at least partially in the space beneath the bed frame.

In a feature of this aspect, the outer panel of each storage compartment is composed of a transparent material to permit the shoe retained in each storage compartment to be visible.

In another feature of this aspect, the inner and outer panels of each storage compartment are composed of a fabric material.

In another feature of this aspect, the bedding accessory further includes a cover for at least substantially concealing each storage compartment. In further features, the cover is an integral component of the bedding accessory; or the cover is a separate component of the bedding accessory.

In another feature of this aspect, the inner panel of each storage compartment includes a pleat for permitting expansion of each storage compartment inwardly into the space beneath the bed frame.

In another feature of this aspect, the side portion is appended only to the edge of the sheet portion adjacent a foot area of the bed frame, whereby a pair of shoes received in each storage compartment is retained at least substantially in the space beneath the foot area of the bed frame.

In another feature of this aspect, the side portion is appended to the edge of the sheet portion adjacent a lateral side area of the bed frame, whereby a pair of shoes received in each storage compartment is retained at least substantially in the space beneath the lateral side area of the bed frame.

In another feature of this aspect, the bedding accessory is usable with a bed frame that includes a footboard.

Another aspect of the present invention relates to a bedding accessory for storing a plurality of articles at least substantially in the space beneath a bed frame, the bedding accessory including: a sheet portion for placement in substantially covering relation to an upper surface of a mattress support structure; at least one side portion appended to an edge of the sheet portion and arranged to hang downwardly therefrom adjacent the space beneath the bed frame; and one or more storage compartments formed on the side portion, each storage compartment being configured to at least substantially retain at least one article therein; wherein each storage compartment is comprised of an outer panel facing outwardly away from the bed frame and an inner panel facing inwardly toward the space beneath the bed frame, wherein, the inner and outer panels of each storage compartment jointly define an opening for receipt of the article, and the outer panel of each storage compartment is composed of a transparent material to permit an article retained in each storage compartment to be visible; whereby, upon receipt of an article, the storage compartment substantially retains the article at least substantially in the space beneath the bed frame.

In another feature of this aspect, the bedding accessory further includes a cover for at least substantially concealing each storage compartment. In further features, the cover is an integral component of the bedding accessory; or the cover is a separate component of the bedding accessory.

In another feature of this aspect, the inner panel of each storage compartment includes a pleat for permitting expansion of each storage compartment inwardly into the space beneath the bed frame.

In another feature of this aspect, the side portion is appended only to the edge of the sheet portion adjacent a foot area of the bed frame, whereby an article received in each storage compartment is retained at least substantially in the space beneath the foot area of the bed frame.

In another feature of this aspect, the side portion is appended to the edge of the sheet portion adjacent a lateral side area of the bed frame, whereby an article received in each storage compartment is retained at least substantially in the space beneath the lateral side area of the bed frame.

In another feature of this aspect, each storage compartment is adapted to receive and store a pair of shoes.

In another feature of this aspect, the bedding accessory is usable with a bed frame that includes a footboard.

Another aspect of the present invention relates to a method of using a bedding accessory for storing at least one shoe at least partially in the space beneath a bed frame, including: providing a bedding accessory having a sheet portion, at least one side portion appended to an edge of the sheet portion, and one or more storage compartments formed on the side portion, each storage compartment being configured to at least substantially retain a shoe therein; arranging the sheet portion of the bedding accessory in substantially covering relation to an upper surface of a mattress support structure; arranging the side portion to hang downwardly from the mattress support structure adjacent the space beneath the bed frame; and placing a shoe into a selected one of the storage compartments, whereby, upon receipt of the shoe, the storage compartment substantially retains the shoe at least partially in the space beneath the bed frame.

Another aspect of the present invention relates to a bedding accessory for storing at least one shoe in the space fully beneath a bed frame, the bedding accessory including: a sheet portion for placement in substantially covering relation to an upper surface of a mattress support structure; at least one side portion appended to an edge of the sheet portion and arranged to hang downwardly therefrom adjacent the space beneath the bed frame; and one or more storage compartments formed on the side portion, each storage compartment being configured to at least substantially retain a shoe therein; wherein each storage compartment is comprised of an outer panel facing outwardly away from the bed frame and an inner panel facing inwardly toward the space beneath the bed frame, wherein, the inner and outer panels of each storage compartment jointly define an opening for receipt of a shoe, the inner panel of each storage compartment includes a pleat for permitting expansion of each storage compartment inwardly into the space beneath the bed frame, and the outer panel of each storage compartment is composed of a transparent material to permit an article retained in each storage compartment to be visible; and whereby, upon receipt of a shoe, the storage compartment substantially retains the shoe in the space fully beneath the bed frame.

In a feature of this aspect, the bedding accessory further includes a cover for at least substantially concealing each storage compartment. In further features, the cover is an integral component of the bedding accessory; or the cover is a separate component of the bedding accessory. In a still further, feature, the cover is a dust ruffle.

In another feature of this aspect, the side portion is appended only to the edge of the sheet portion adjacent a foot area of the bed frame, whereby a pair of shoes received in each storage compartment is retained in the space fully beneath the foot area of the bed frame.

In another feature of this aspect, the side portion is appended to the edge of the sheet portion adjacent a lateral side area of the bed frame, whereby a pair of shoes received in each storage compartment is retained in the space fully beneath the lateral side area of the bed frame.

In another feature of this aspect, the bedding accessory is usable with a bed frame that includes a footboard.

In addition to the aforementioned aspects and features of the present invention, it should be noted that the present invention further encompasses the various possible combinations and subcombinations of such aspects and features.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
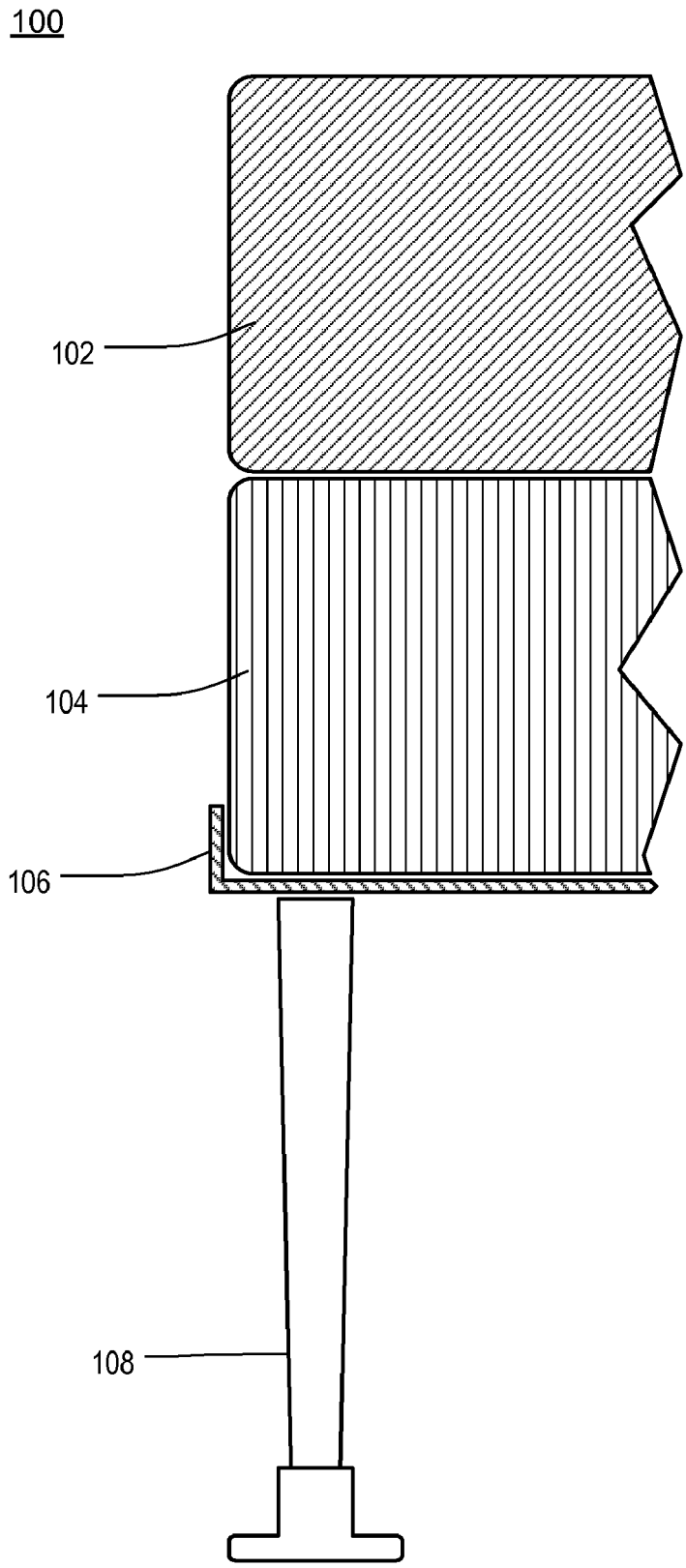
FIG. 1 is a fragmentary end cross-sectional view of a side of a conventional bed.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

FIG. 1 is a fragmentary end cross-sectional view of a side of a conventional bed 100. As shown therein, a conventional bed typically (though not always) includes a mattress 102, a box spring 104, a bed frame 106 and a plurality of frame legs 108. The bed frame 106, which is elevated above the floor by the frame legs 108, supports the box spring 104, and the mattress 102 rests on top of the box spring 104.

Figure 2:
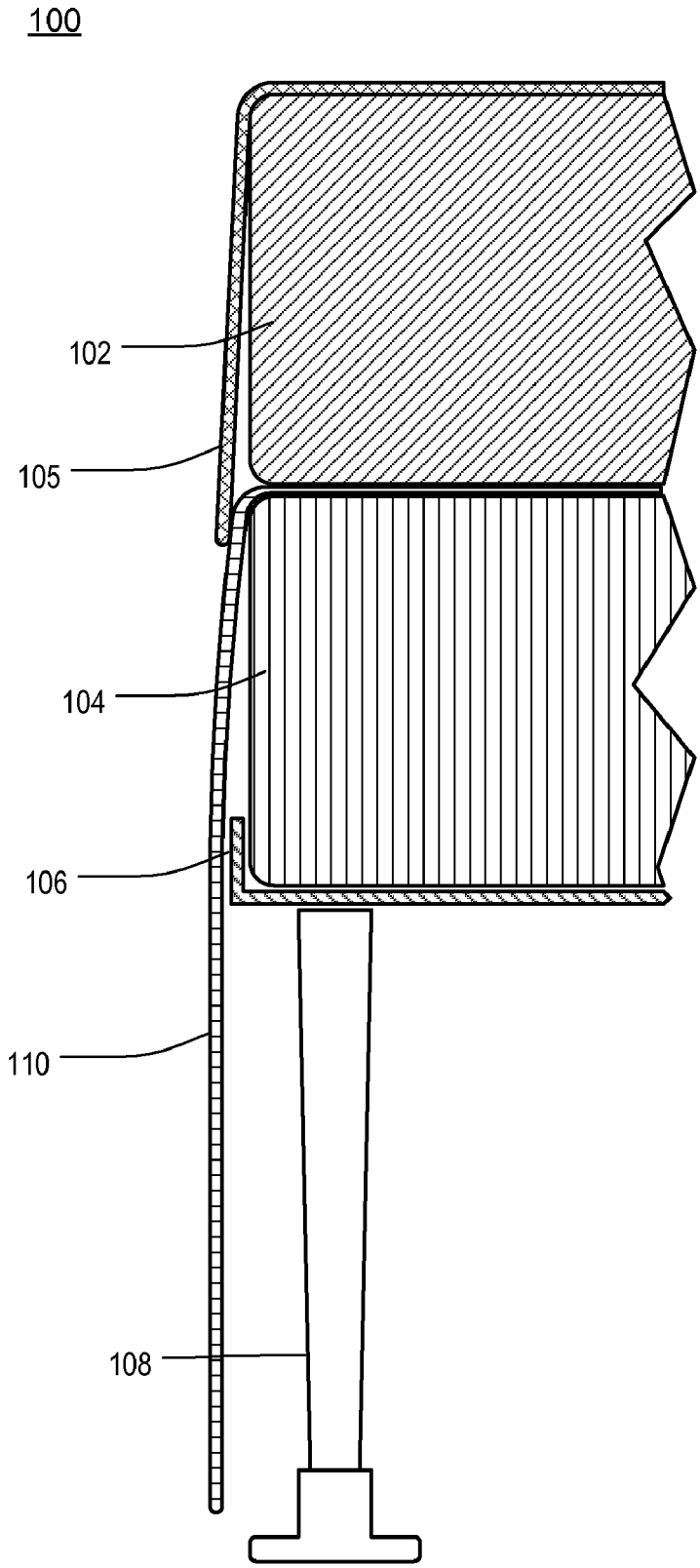
FIG. 2 is a fragmentary end cross-sectional view of the bed of FIG. 1, illustrating a prior art dust ruffle and bedspread installed thereon.

FIG. 2 is a fragmentary end cross-sectional view of the bed 100 of FIG. 1, illustrating a prior art dust ruffle 110 and bedspread 105 installed thereon. The dust ruffle 110 is supported by the top of the box spring 104, beneath the mattress 102, and hangs over the side of the box spring 104, often all the way to or near the floor. The bedspread 105, which may be a comforter, quilt, blanket, sheet, or the like, is supported by the top of the mattress 102, and hangs over the side of the mattress 102, often all the way to or near the top of the dust ruffle 110. Together, the bedspread 105 and dust ruffle 110 cover, completely or nearly completely, both the mattress 102 and the box spring 104 and hide the open space beneath the bed frame 106 from view.

Figure 3:
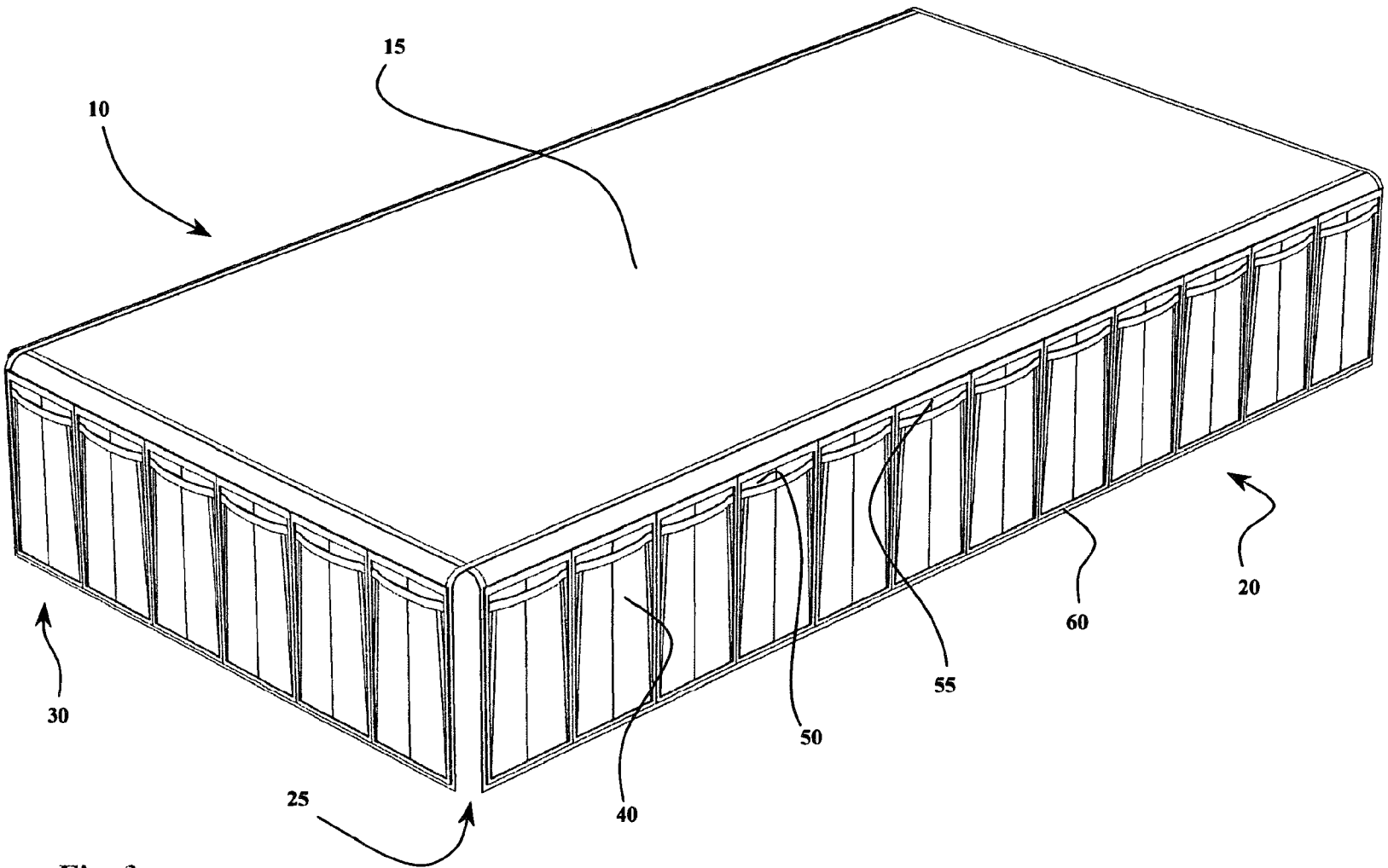
FIG. 3 is a perspective view of a bedding accessory in accordance with a first preferred embodiment of the present invention.

FIG. 3 is a perspective view of a bedding accessory 10, sometimes referred to by the name or brand "ShoeSkirt," in accordance with a first preferred embodiment of the present invention. The bedding accessory includes an upper portion 15 and one or more draping sides 20. In at least some embodiments, the bedding accessory 10 is made of a combination of sheet materials and stitching.

In its preferred embodiment, the bedding accessory 10 is designed to store shoes, with one shoe or one pair of shoes in each of a plurality of pockets, pouches or other storage compartments 30 (in at least one embodiment, approximately thirty pairs of shoes on a twin-sized bed). It can also or alternatively hold a variety of other items in each pocket 30.

The pockets 30 themselves are designed so that the bulk of their contents is disposed underneath a bed, within a perimeter defined by the four sides of the box-spring or by the four sides of the bed frame 106. The construction of the bedding accessory 10 facilitates this condition.

The upper portion 15 is attached to at least one draping side 20. The upper portion 15 and the side(s) 20 are made of an appropriate linen, a gathered material (such as polypropylene). Between two adjacent sides 20, a slot 25 is provided. This slot 25 allows the bedding accessory 10 to be used with beds 100 of slight variation from nominal size, as well as with bed frames 106 that include a footboard. In at least one proposed commercial embodiment, though, bedding accessories 10 having different overall dimensions will be made to fit different standard bed sizes (i.e. King, Queen, Full, etc.).

Each draping side 20 comprises at least one inner panel 50 and one outer panel 40, in the form of a pocket, pouch or other storage compartment 30. One or both of the inner and outer panels 50,40 can be primarily transparent and made of a clear vinyl, or they can be made of a suitable fabric, or a combination of either. The inner panel 50 has at least one pleat 55 to allow the pocket 30 to expand toward the interior of the bedding accessory 10, and underneath the bed frame 106. The inner and outer panels 50,40 may be secured together with thread stitching 60 along their sides and bottom. The top edges of the panels 50,40 remain unfastened to allow articles to be inserted and removed easily. The inner panel 50 is stitched to the upper portion 15, to form the side 20 of the bedding accessory 10.

Figure 4A:
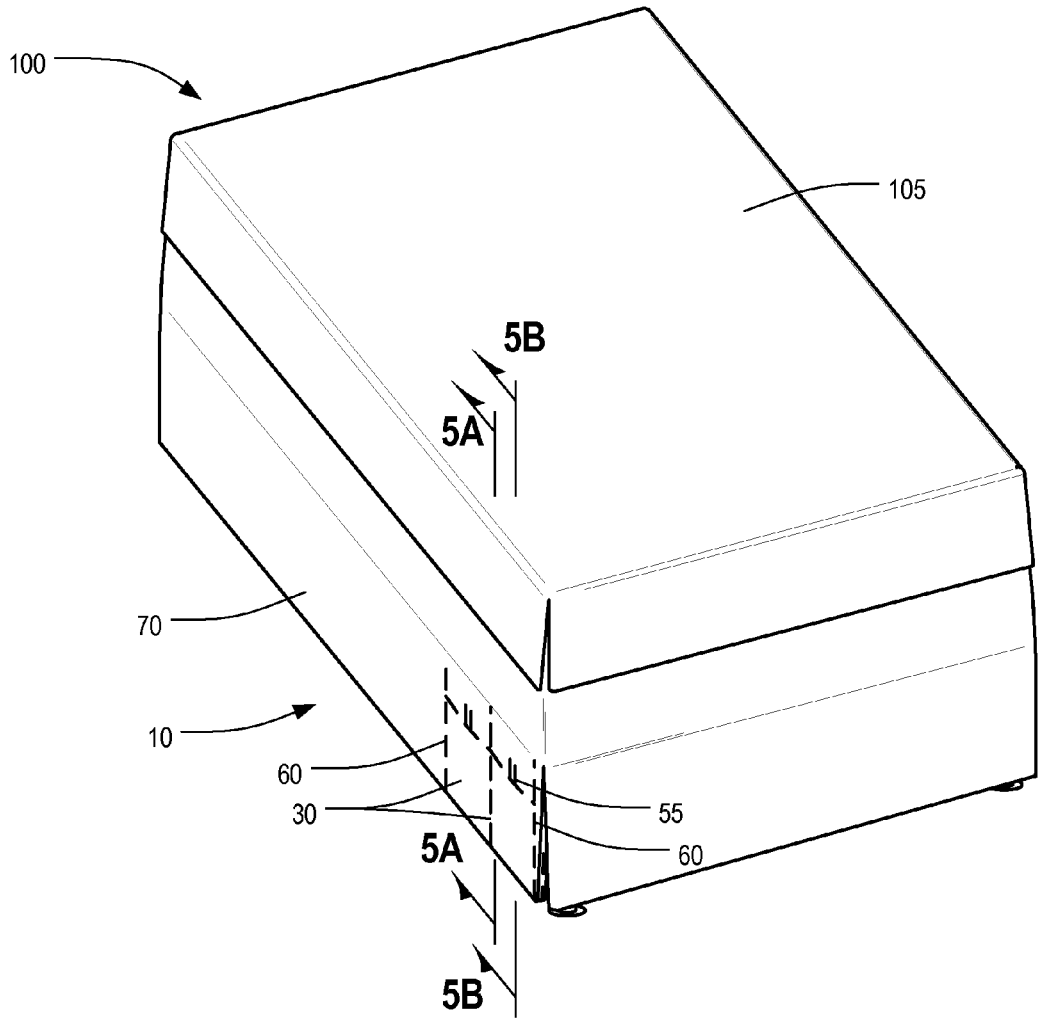
FIG. 4A is a perspective view of a bedding accessory, installed on the bed of FIG. 1, in accordance with a second preferred embodiment of the present invention.
Figure 4B:
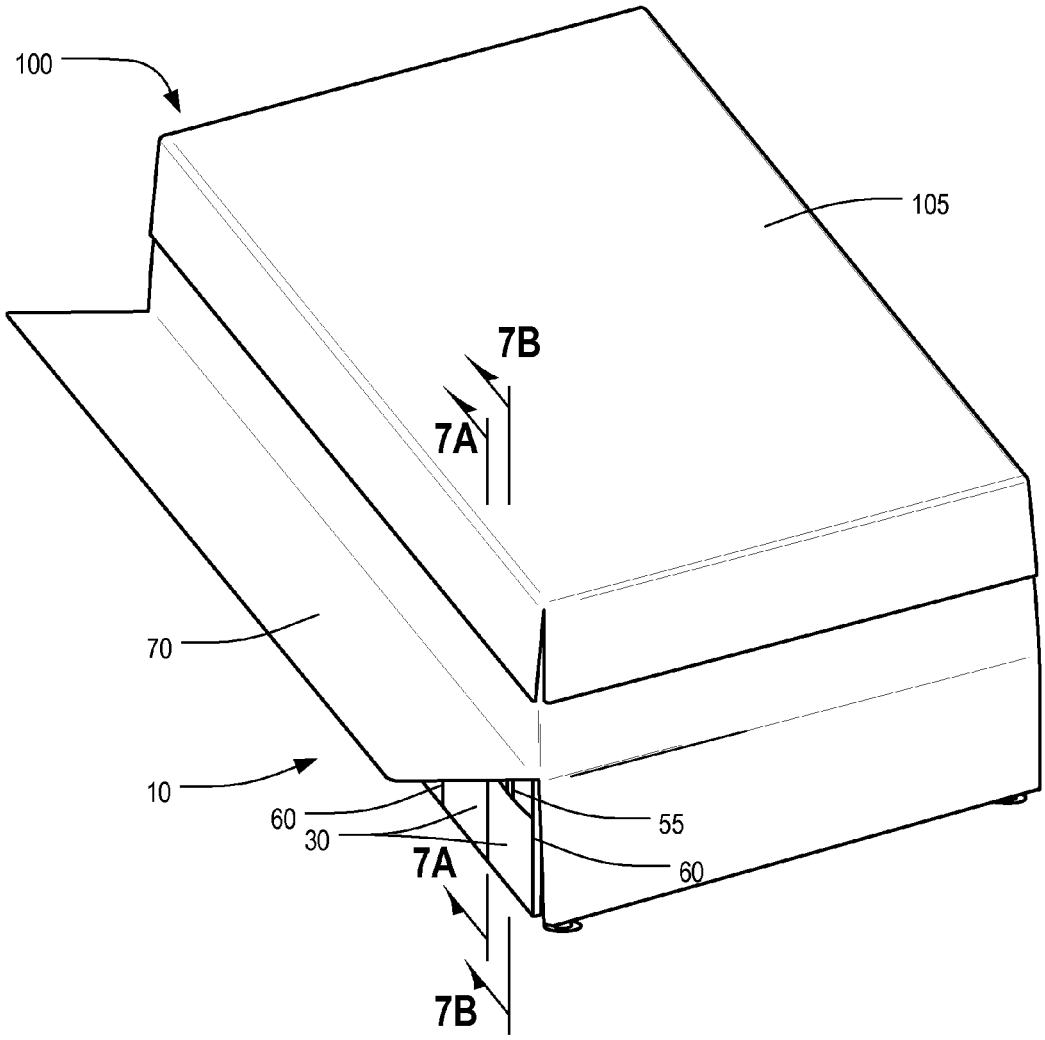
FIG. 4B is a perspective view of the bedding accessory and bed of FIG. 4A, shown with one side of the bedding accessory cover lifted to permit visual and physical access to the pockets of the bedding accessory.

FIG. 4A is a perspective view of a bedding accessory 10, installed on the bed 100 of FIG. 1, in accordance with a second preferred embodiment of the present invention. As shown therein, the bedding accessory 10, two of which's pockets 30 are shown in dashed lines in FIG. 4A, may further include a bedding accessory cover 70 that is supported by the top of the box spring 104, over the upper portion 15 but beneath the mattress 102, and hangs over the side of the box spring 104, often all the way to or near the bottom of the storage compartments 30, to hide the storage compartments 30 from view. Alternatively, the bedding accessory cover 70 may include only a side panel whose top edge is sewn or otherwise attached to the peripheral edge of the upper portion 15, near the seam or intersection formed with each respective draping side 20. FIG. 4B is a perspective view of the bedding accessory 10 and bed 100 of FIG. 4A, shown with one side of the bedding accessory cover 70 lifted to permit visual and physical access to the pockets 30 of the bedding accessory 10.

Figure 5A:
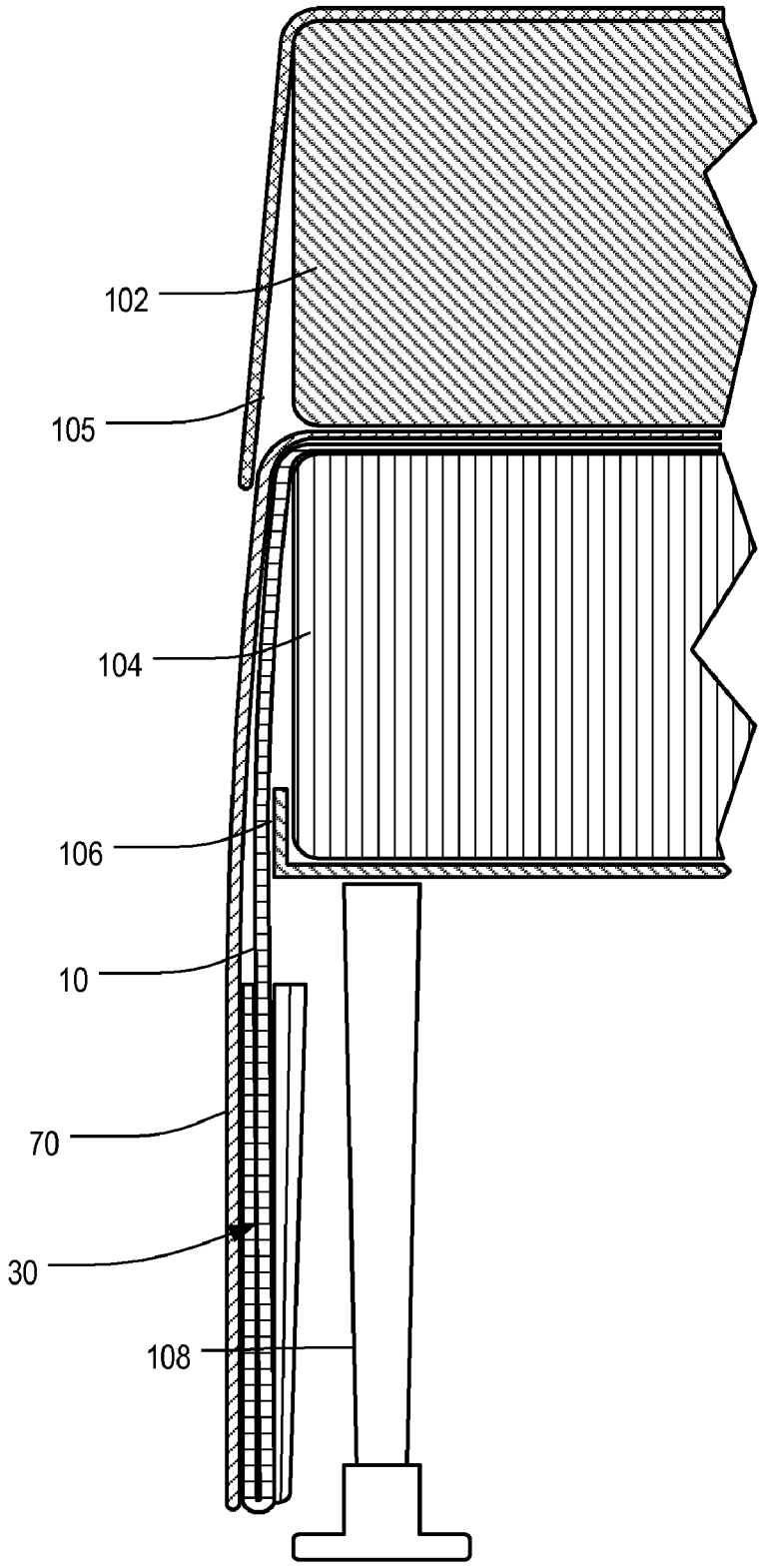
FIG. 5A is a fragmentary end cross-sectional view of the bedding accessory and bed of FIG. 4A, taken along line 5A-5A.
Figure 5B:
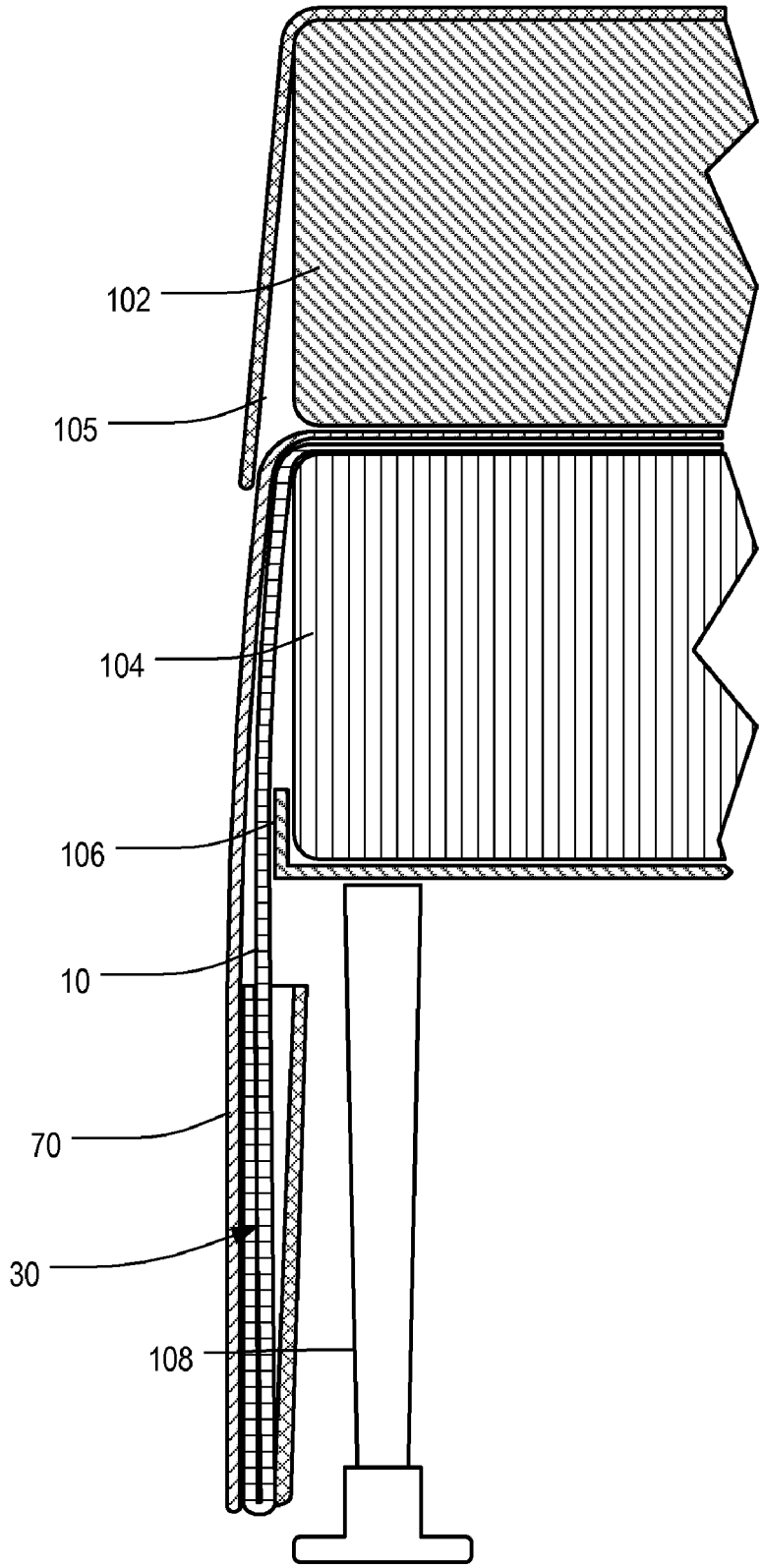
FIG. 5B is a fragmentary end cross-sectional view of the bedding accessory and bed of FIG. 4A, taken along line 5B-5B.
Figure 6A:
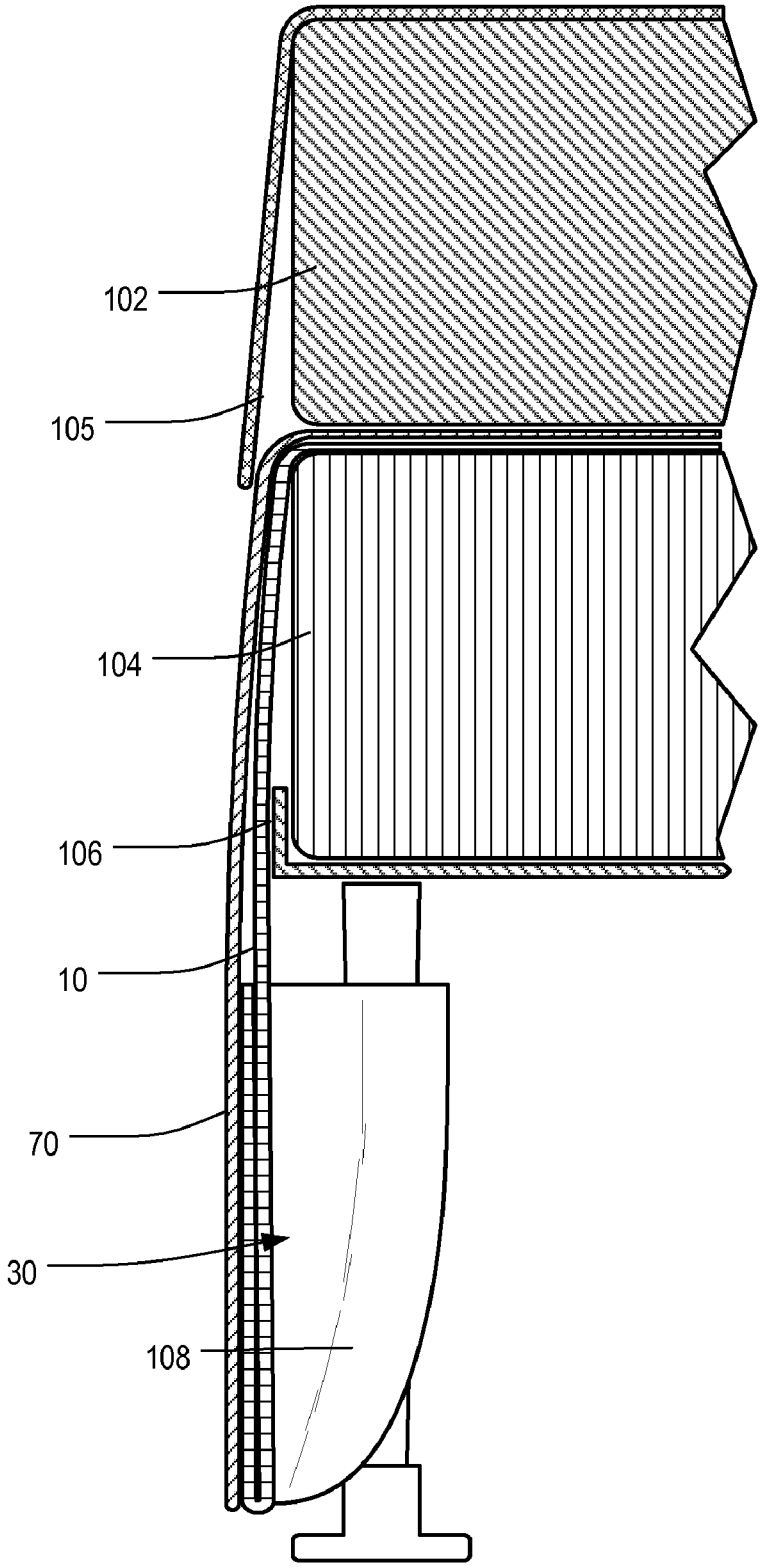
FIG. 6A is a fragmentary end cross-sectional view of the bedding accessory and bed of FIG. 4A, taken along line 5A-5A, shown with one or more shoes stored therein.
Figure 6B:
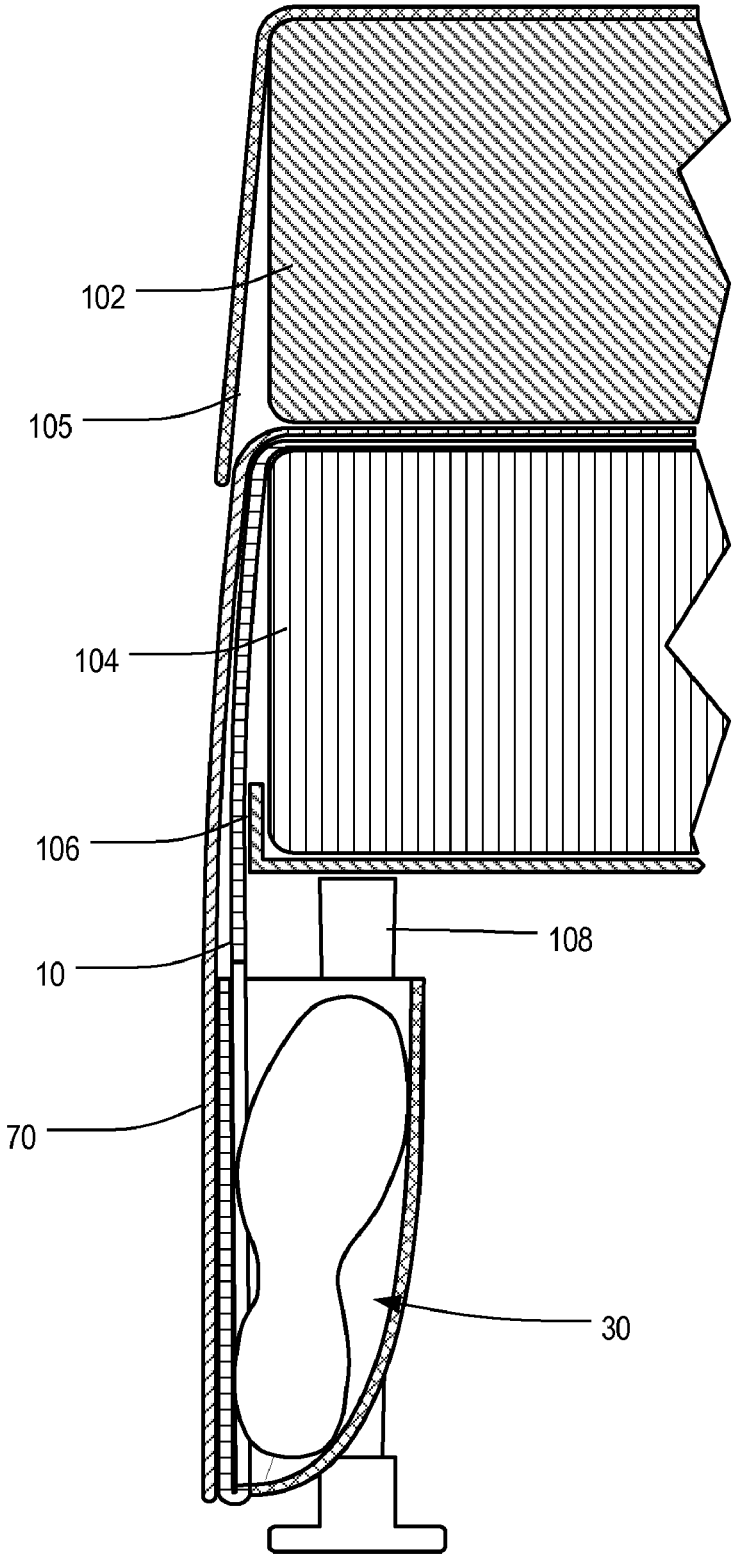
FIG. 6B is a fragmentary end cross-sectional view of the bedding accessory and bed of FIG. 4A, taken along line 5B-5B, shown with one or more shoes stored therein.
Figure 7A:
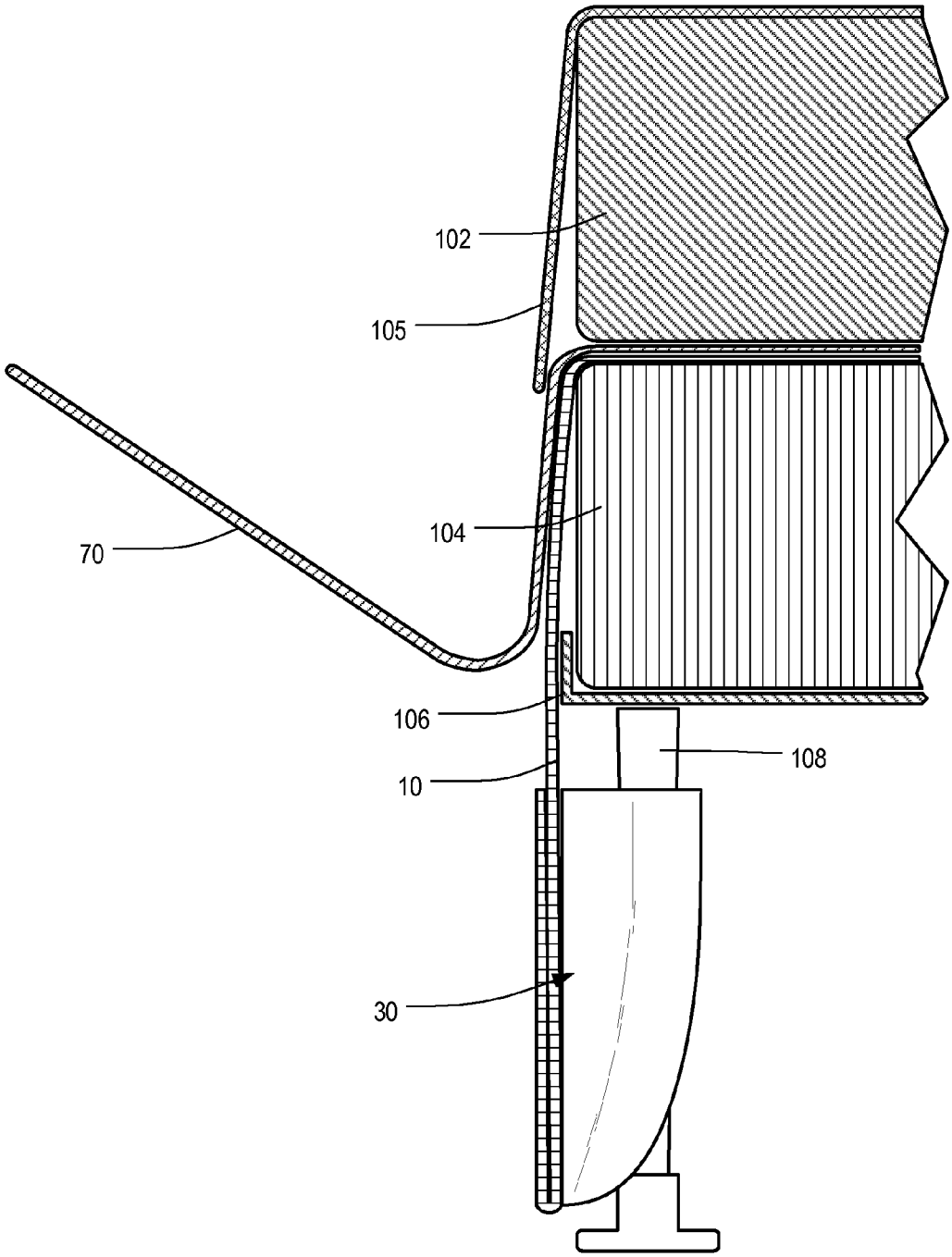
FIG. 7A is a fragmentary end cross-sectional view of the bedding accessory and bed of FIG. 4B, taken along line 7A-7A, shown with one or more shoes stored therein.
Figure 7B:
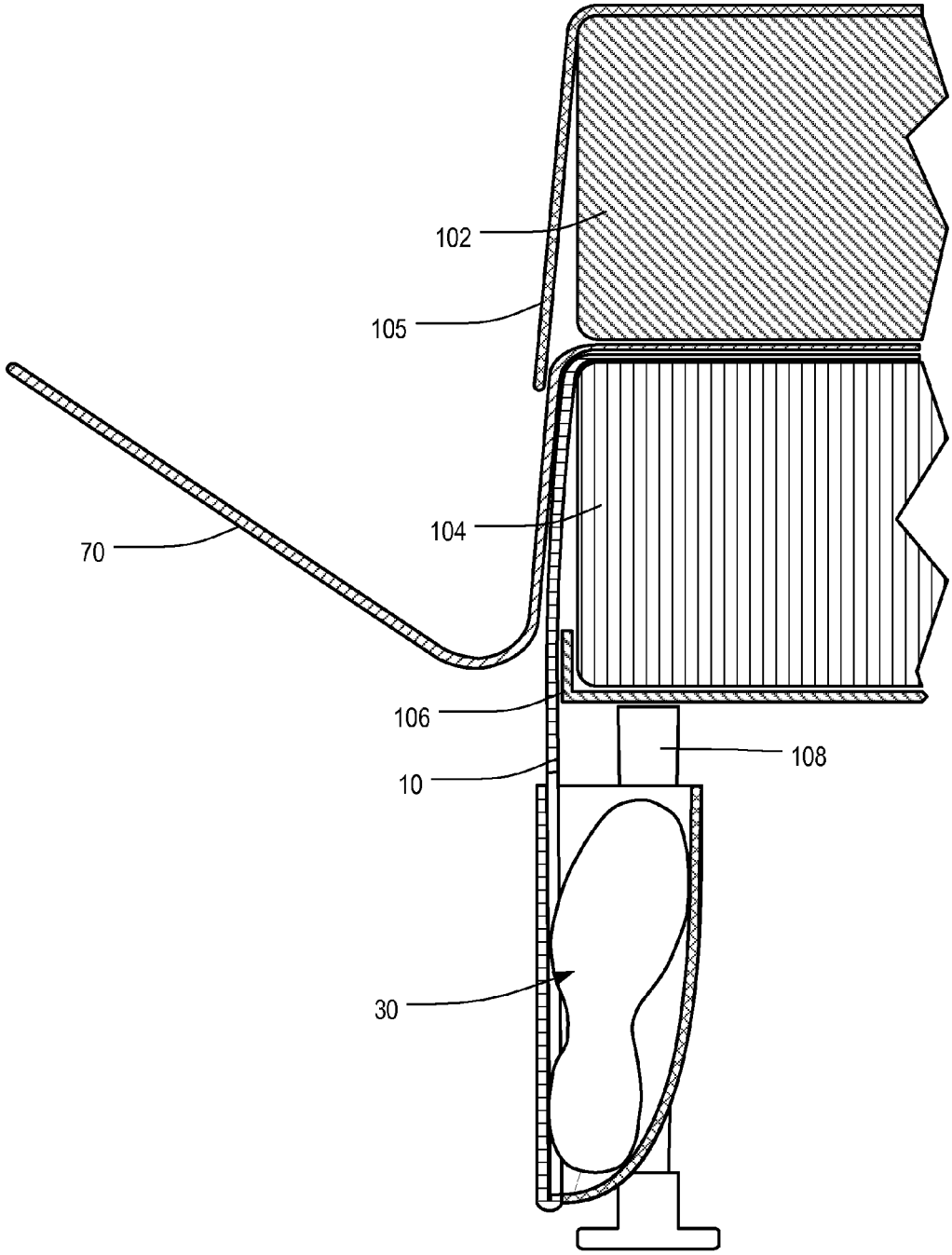
FIG. 7B is a fragmentary end cross-sectional view of the bedding accessory and bed of FIG. 4B, taken along line 7B-7B, shown with one or more shoes stored therein.

FIG. 5A is a fragmentary end cross-sectional view of the bedding accessory and bed of FIG. 4A, taken along line 5A-5A. FIG. 5B is a fragmentary end cross-sectional view of the bedding accessory and bed of FIG. 4A, taken along line 5B-5B. FIG. 6A is a fragmentary end cross-sectional view of the bedding accessory and bed of FIG. 4A, taken along line 5A-5A, shown with one or more shoes stored therein. FIG. 6B is a fragmentary end cross-sectional view of the bedding accessory and bed of FIG. 4A, taken along line 5B-5B, shown with one or more shoes stored therein. FIG. 7A is a fragmentary end cross-sectional view of the bedding accessory and bed of FIG. 4B, taken along line 7A-7A, shown with one or more shoes stored therein. FIG. 7B is a fragmentary end cross-sectional view of the bedding accessory and bed of FIG. 4B, taken along line 7B-7B, shown with one or more shoes stored therein.

Figure 8A:
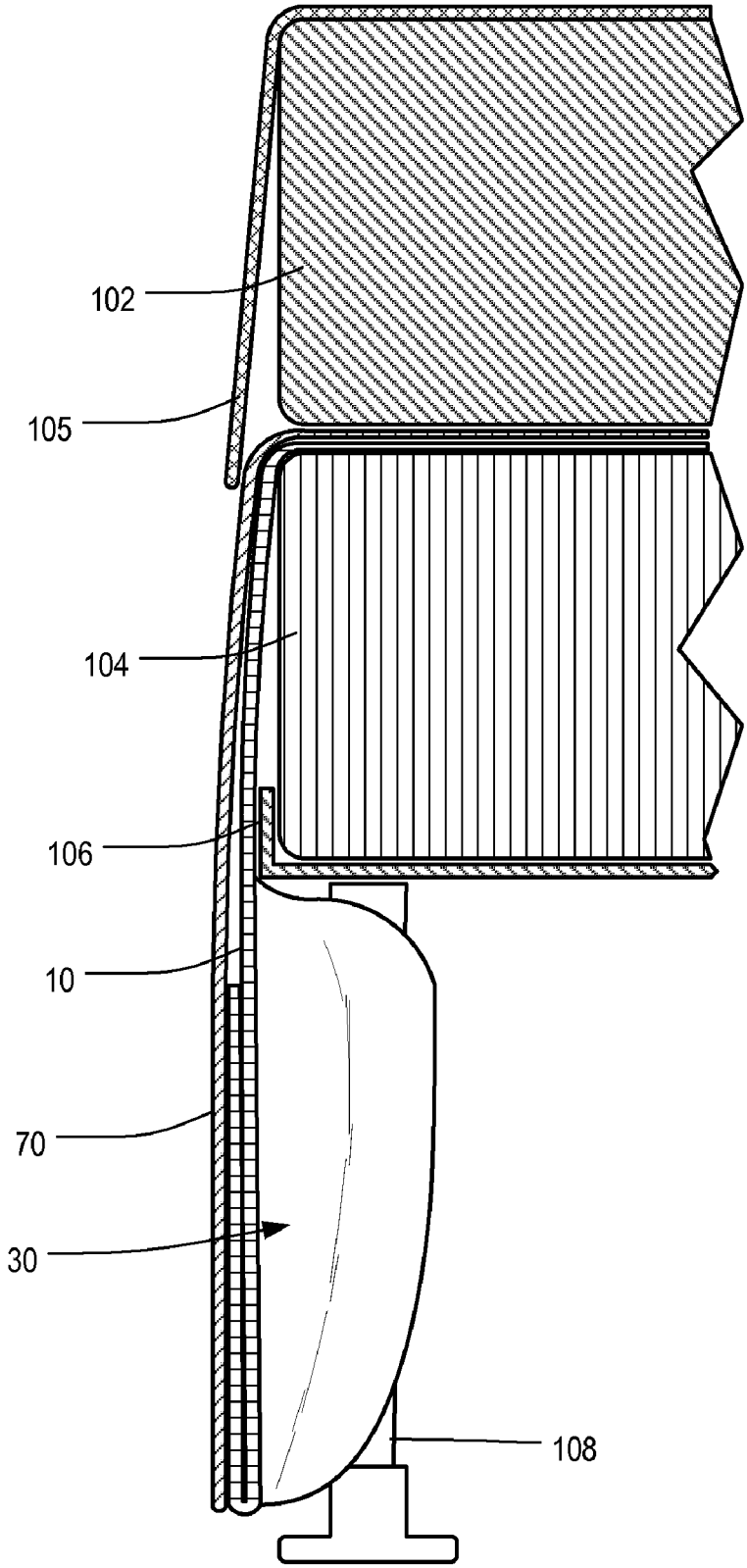
FIG. 8A is a fragmentary end cross-sectional view, similar to that of FIG. 6A, of a bedding accessory, installed on a bed, in accordance with a third preferred embodiment of the present invention.
Figure 8B:
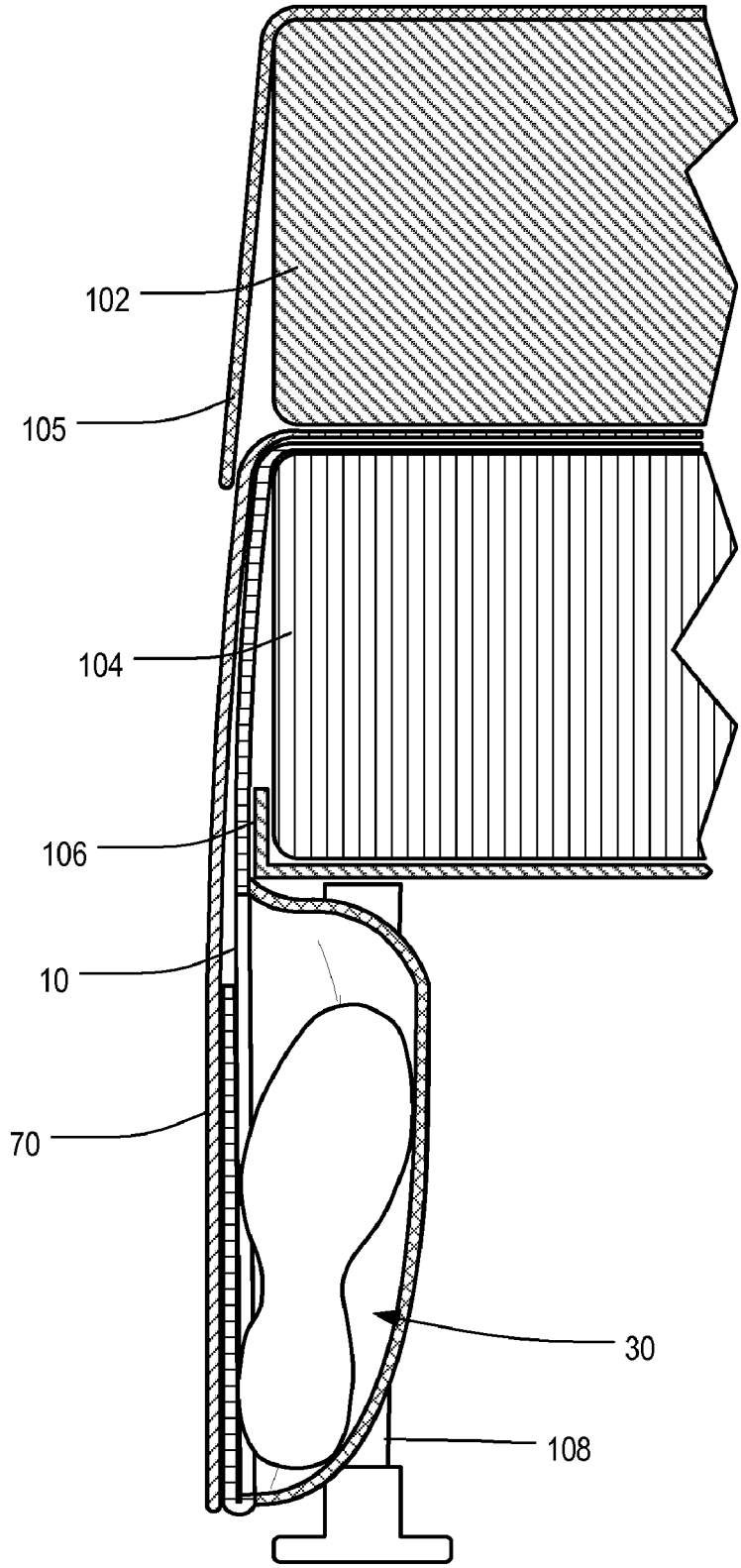
FIG. 8B is a fragmentary end cross-sectional view, similar to that of FIG. 6B, of a bedding accessory, installed on a bed, in accordance with the third preferred embodiment of the present invention.

FIG. 8A is a fragmentary end cross-sectional view, similar to that of FIG. 6A, of a bedding accessory, installed on a bed, in accordance with a third preferred embodiment of the present invention. FIG. 8B is a fragmentary end cross-sectional view, similar to that of FIG. 6B, of a bedding accessory, installed on a bed, in accordance with the third preferred embodiment of the present invention.

Figure 9A:
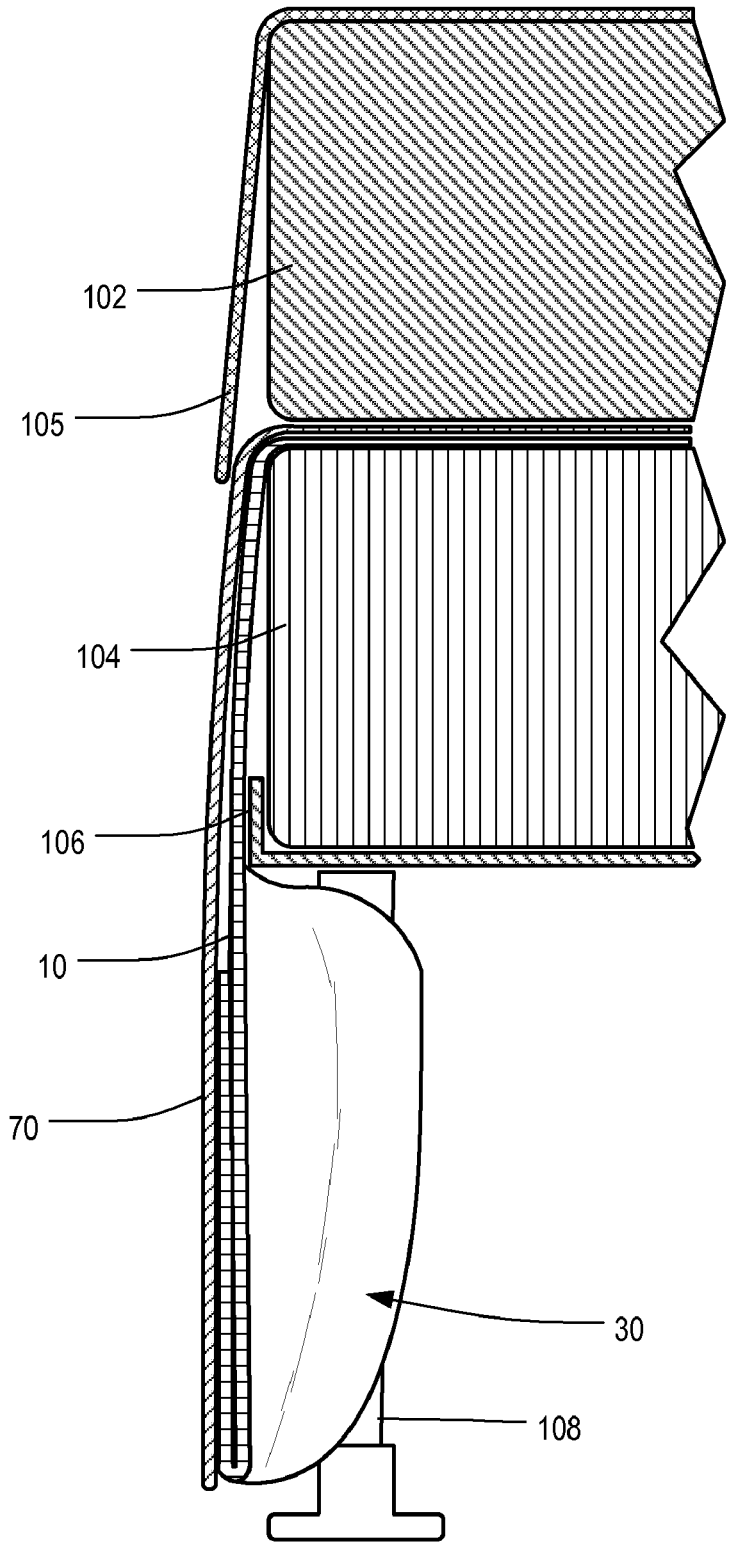
FIG. 9A is a fragmentary end cross-sectional view, similar to that of FIG. 6A, of a bedding accessory, installed on a bed, in accordance with a fourth preferred embodiment of the present invention.
Figure 9B:
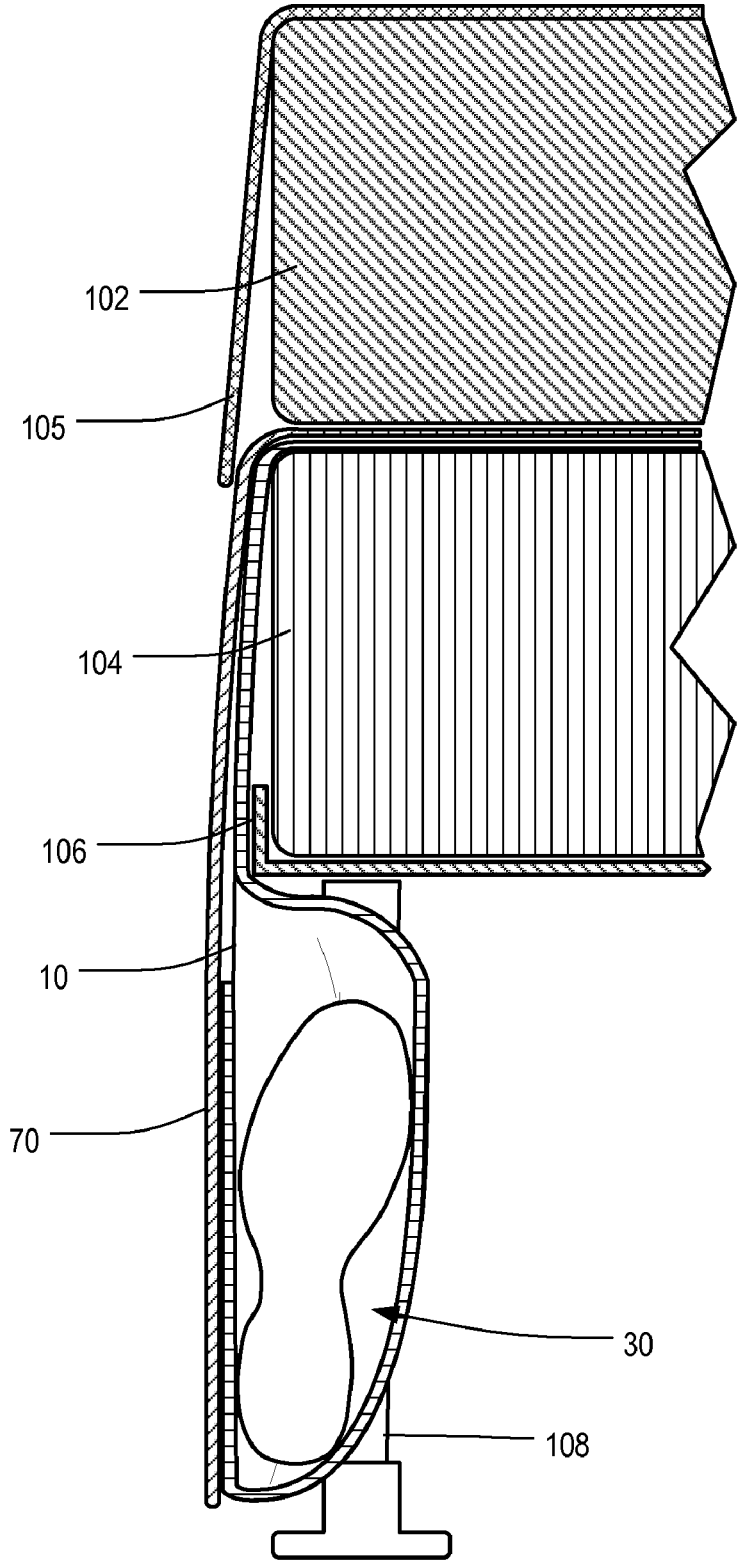
FIG. 9B is a fragmentary end cross-sectional view, similar to that of FIG. 6B, of a bedding accessory, installed on a bed, in accordance with the fourth preferred embodiment of the present invention.

FIG. 9A is a fragmentary end cross-sectional view, similar to that of FIG. 6A, of a bedding accessory, installed on a bed, in accordance with a fourth preferred embodiment of the present invention. FIG. 9B is a fragmentary end cross-sectional view, similar to that of FIG. 6B, of a bedding accessory, installed on a bed, in accordance with the fourth preferred embodiment of the present invention.

Figure 10A:
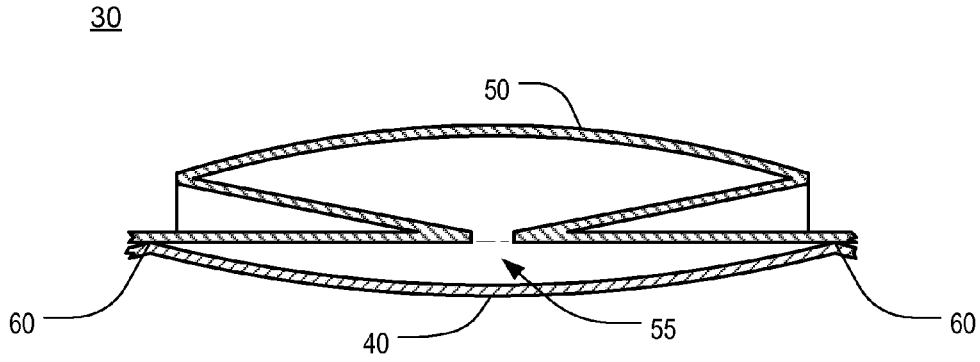
FIG. 10A is a top cross-sectional view of one of the pockets of the bedding accessory of FIGS. 4A and 4B, shown in a collapsed state.
Figure 10B:
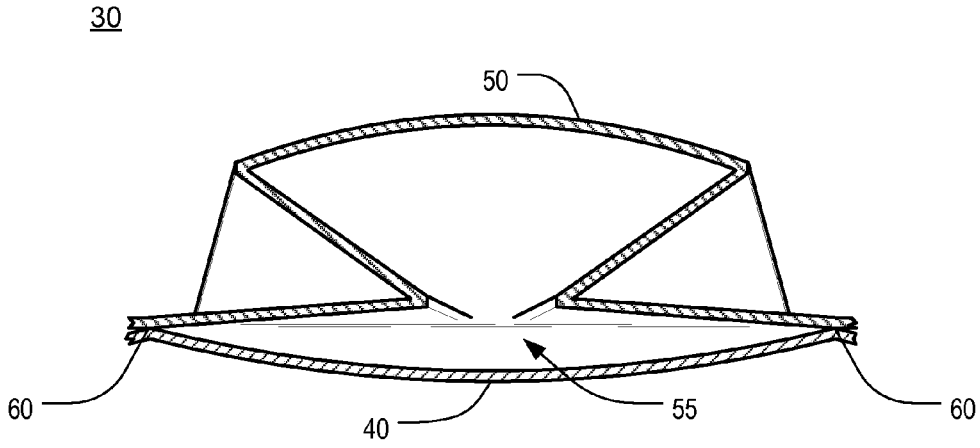
FIG. 10B is a top cross-sectional view of one of the pockets of the bedding accessory of FIGS. 4A and 4B, shown in an expanded state.

FIG. 10A is a top cross-sectional view of one of the pockets 30 of the bedding accessory 10 of FIGS. 4A and 4B, shown in a collapsed state. FIG. 10B is a top cross-sectional view of one of the pockets 30 of the bedding accessory 10 of FIGS. 4A and 4B, shown in an expanded state.

Figure 11:
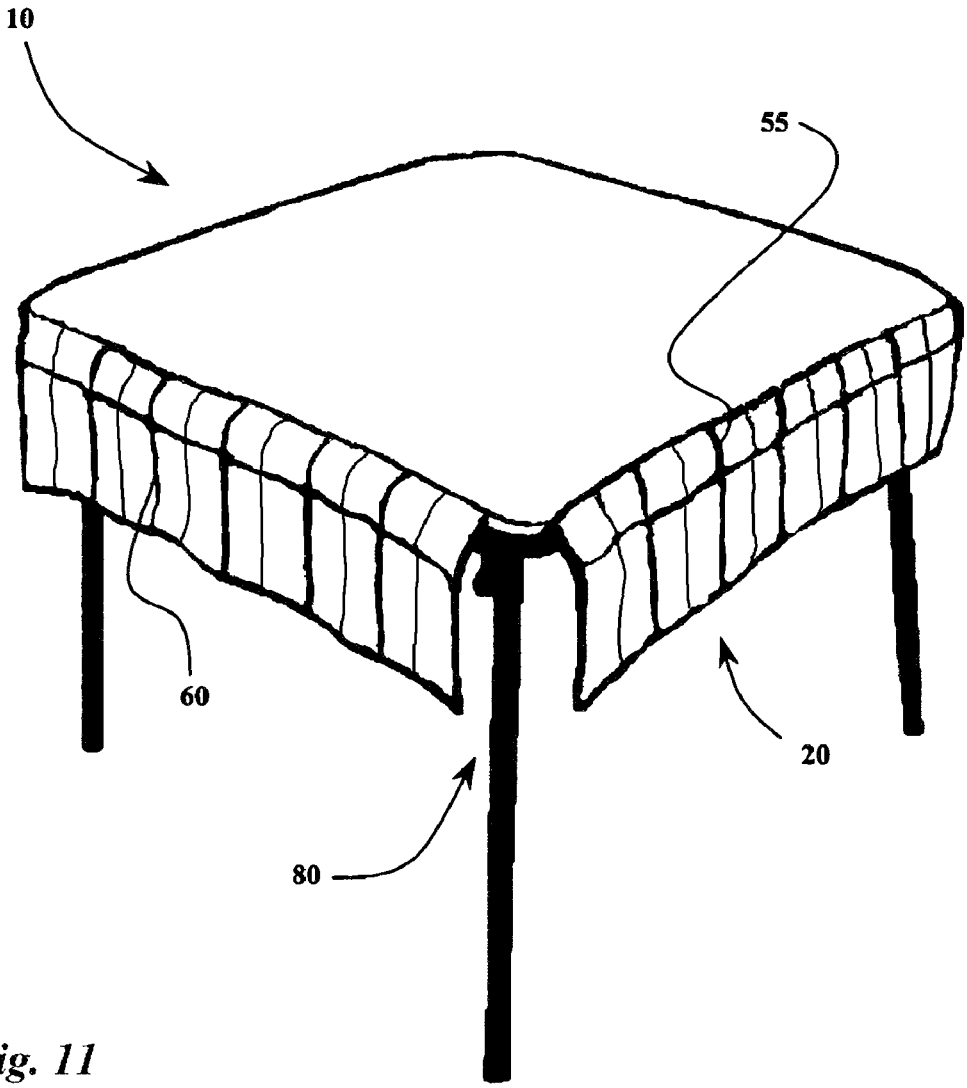
FIG. 11 is a perspective view of an alternate embodiment of the bedding accessory (mounted on an ordinary collapsible craft table).

FIG. 11 is a perspective view of an alternate embodiment of the bedding accessory (mounted on an ordinary collapsible craft table). Here, the bedding accessory 10 is used as a table cover for hobbies and games, with at least one pocketed side 20 that hangs downward below the surface of the table 80. An example of a pleat 55 is shown, as well as an area of stitching 60.

Another embodiment is a TravelSkirt (not shown). This is a section of a bedding accessory that slips under the end of the bed to provide, in at least one embodiment, approximately 12 pockets of storage (for queen-size).

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A bedding accessory for storing at least one pair of shoes in the space fully beneath a bed frame, the bedding accessory comprising:

(a) a sheet portion for placement in substantially covering relation to an upper surface of a mattress support structure;

(b) at least one side portion appended to an edge of the sheet portion and arranged to hang downwardly therefrom adjacent the space beneath the bed frame; and (c) one or more storage compartments formed on the side portion, each storage compartment being configured to at least substantially retain a pair of shoes therein;

(d) wherein each storage compartment is comprised of an outer panel facing outwardly away from the bed frame and an inner panel facing inwardly toward the space beneath the bed frame, wherein, (i) the inner and outer panels of each storage compartment jointly define an opening for receipt of a pair of shoes, (ii) the inner panel of each storage compartment includes a pleat for permitting expansion of each storage compartment inwardly into the space beneath the bed frame, and (iii) the outer panel of each storage compartment is composed of a transparent material to permit an article retained in each storage compartment to be visible; and (e) whereby, upon receipt of a pair of shoes, the storage compartment substantially retains the pair of shoes in the space fully beneath the bed frame.

2. The bedding accessory of claim 1, further comprising a cover for at least substantially concealing each storage compartment.

3. The bedding accessory of claim 2, wherein the cover is an integral component of the bedding accessory.

4. The bedding accessory of claim 2, wherein the cover is a separate component of the bedding accessory.

5. The bedding accessory of claim 2, wherein the cover is a dust ruffle.

6. The bedding accessory of claim 1, wherein the side portion is appended only to the edge of the sheet portion adjacent a foot area of the bed frame, whereby a pair of shoes received in each storage compartment is retained in the space fully beneath the foot area of the bed frame.

7. The bedding accessory of claim 1, wherein the side portion is appended to the edge of the sheet portion adjacent a lateral side area of the bed frame, whereby a pair of shoes received in each storage compartment is retained in the space fully beneath the lateral side area of the bed frame.

8. The bedding accessory of claim 1, wherein the bedding accessory is configured for use with a bed frame that includes a footboard.

9. A bedding accessory for storing at least one pair of shoes in the space fully beneath a bed frame, the bedding accessory comprising:

(a) a sheet portion having four side edges for placement in substantially covering relation to an upper surface of a mattress support structure;

(b) at least two separate side portions appended to corresponding side edges of the sheet portion and arranged to hang downwardly therefrom adjacent the space beneath the bed frame; and (c) one or more storage compartments formed on each of the separate side portions, each storage compartment being configured to at least substantially retain a pair of shoes therein;

(d) wherein each storage compartment is comprised of an outer panel facing outwardly away from the bed frame and an inner panel facing inwardly toward the space beneath the bed frame, wherein, (i) the inner and outer panels of each storage compartment jointly define an opening for receipt of a pair of shoes, (ii) the inner panel of each storage compartment includes a pleat for permitting expansion of each storage compartment inwardly into the space beneath the bed frame, and (iii) the outer panel of each storage compartment is composed of a transparent material to permit an article retained in each storage compartment to be visible; and (e) whereby, upon receipt of a pair of shoes, the storage compartment substantially retains the pair of shoes in the space fully beneath the bed frame.

10. The bedding accessory of claim 9, further comprising a cover for at least substantially concealing each storage compartment.

11. The bedding accessory of claim 10, wherein the cover is an integral component of the bedding accessory.

12. The bedding accessory of claim 10, wherein the cover is a separate component of the bedding accessory.

13. The bedding accessory of claim 10, wherein the cover is a dust ruffle.

14. The bedding accessory of claim 9, wherein the bedding accessory is configured for use with a bed frame that includes a footboard.

15. A bedding accessory for storing one or more articles in the space fully beneath a bed frame, the bedding accessory comprising:

(a) a generally rectangular sheet portion having four sides for placement in substantially covering relation to an upper surface of a mattress support structure;

(b) at least one generally rectangular side portion having an upper edge, a lower edge, and two free side edges, wherein the upper edge of the at least one side portion is appended to the sheet portion only along at least a portion of the length of one of the sides thereof such that the at least one side portion is arranged to hang downwardly therefrom adjacent the space beneath the bed frame; and (c) one or more storage compartments formed on the at least one side portion;

(d) wherein each storage compartment is comprised of an outer panel facing outwardly away from the bed frame and an inner panel facing inwardly toward the space beneath the bed frame, wherein, (i) the inner and outer panels of each storage compartment jointly define an opening, and (ii) the inner panel of each storage compartment includes a pleat for permitting expansion of each storage compartment inwardly into the space beneath the bed frame, (e) whereby, the storage compartment substantially retains the one or more articles in the space fully beneath the bed frame.

16. The bedding accessory of claim 15, wherein the bedding accessory is configured for use with a bed frame that includes a footboard.

17. The bedding accessory of claim 15, wherein the one or more articles is a pair of shoes.

18. The bedding accessory of claim 15, further comprising a cover for at least substantially concealing each storage compartment.

19. The bedding accessory of claim 18, wherein the cover is an integral component of the bedding accessory.

20. The bedding accessory of claim 18, wherein the cover is a separate component of the bedding accessory.

* * * * *